US009505420B2

(12) United States Patent
Tsukamoto

(10) Patent No.: US 9,505,420 B2
(45) Date of Patent: Nov. 29, 2016

(54) TRAIN CONTROL SYSTEM

(71) Applicant: THE NIPPON SIGNAL CO., LTD., Tokyo (JP)

(72) Inventor: Yasushi Tsukamoto, Kuki (JP)

(73) Assignee: THE NIPPON SIGNAL CO., LTD., Tokyo (JP)

( * ) Notice: Subject to any disclaimer, the term of this patent is extended or adjusted under 35 U.S.C. 154(b) by 0 days.

(21) Appl. No.: 14/228,145

(22) Filed: Mar. 27, 2014

(65) Prior Publication Data

US 2014/0209759 A1 Jul. 31, 2014

Related U.S. Application Data

(63) Continuation of application No. PCT/JP2012/074286, filed on Sep. 21, 2012.

(30) Foreign Application Priority Data

Sep. 30, 2011 (JP) ..... 2011-218253

(51) Int. Cl.
*B61L 27/04* (2006.01)
*B61L 27/00* (2006.01)
(Continued)

(52) U.S. Cl.
CPC ..... *B61L 27/04* (2013.01); *B61L 3/008* (2013.01); *B61L 25/026* (2013.01); *B61L 27/0038* (2013.01); *B61L 3/125* (2013.01)

(58) Field of Classification Search
CPC ..... B61L 27/04; B61L 27/0038
USPC ..... 246/2 S
See application file for complete search history.

(56) References Cited

U.S. PATENT DOCUMENTS 5,420,883 A * 5/1995 Swensen ..... B61L 3/125 342/450
6,580,976 B1 * 6/2003 Belcea ..... B60T 7/128 340/988
7,578,485 B1 8/2009 Ohmstede
(Continued)

FOREIGN PATENT DOCUMENTS

CN 101544237 A 9/2009
EP 0822909 A1 2/1998
(Continued)

OTHER PUBLICATIONS

Liu, "Research on Train Safety Location Method in CBTC System," Chinese Master's Thesis Full-text Database Engineering Science and Technology II, Aug. 8, 2008, pp. C033-C180.
(Continued)

*Primary Examiner* — Zachary Kuhfuss
(74) *Attorney, Agent, or Firm* — McDermott Will & Emery LLP

(57) ABSTRACT

A train control system includes: an on-board device 3 mounted on a train 2 travelling on a track 1; a vehicle radio set 7 that transmits and receives travel distance information and speed information of the train 2 obtained by the on-board device 3; a wayside radio set 8 disposed at a predetermined location of the track 1 and transmitting information to and receives information from the vehicle radio set 7; and a ground device 9 connected to the wayside radio set 8, in which the ground device 9 obtains a location of the train 2 based on the travel distance information and the speed information of the train 2 transmitted from the on-board device 3, and sets a safety buffer on each of a travelling direction side of the train 2 and the opposite side thereof, the safety buffer being only set to be longer, during train 2 travelling.

3 Claims, 3 Drawing Sheets

(51) Int. Cl.

| | |
|---|---|
| ***B61L 25/02*** | (2006.01) |
| ***B61L 3/00*** | (2006.01) |
| *B61L 3/12* | (2006.01) |

(56) References Cited

U.S. PATENT DOCUMENTS

| | | | | |
|---|---|---|---|---|
| 2003/0105560 | A1* | 6/2003 | Sugita | B61L 27/0038 701/19 |
| 2005/0133673 | A1* | 6/2005 | Sugita | B61L 3/125 246/167 R |
| 2008/0068164 | A1* | 3/2008 | Campbell | B61L 23/34 340/572.1 |
| 2009/0210154 | A1 | 8/2009 | Willis et al. | |
| 2011/0046827 | A1 | 2/2011 | Yoon et al. | |
| 2012/0197466 | A1* | 8/2012 | Yoshimoto | B60L 15/40 701/20 |
| 2012/0292119 | A1 | 11/2012 | Tsuruta et al. | |
| 2013/0018531 | A1* | 1/2013 | Kumar | B61L 3/006 701/2 |
| 2013/0062474 | A1* | 3/2013 | Baldwin | B61L 29/282 246/122 R |
| 2014/0209752 | A1* | 7/2014 | Myokei | B61L 25/026 246/27 |
| 2014/0209755 | A1* | 7/2014 | Takahashi | B60L 15/40 246/167 R |
| 2014/0209758 | A1* | 7/2014 | Kurita | B60L 15/40 246/2 S |
| 2015/0008293 | A1* | 1/2015 | Hatazaki | B61L 27/0038 246/30 |
| 2015/0051761 | A1* | 2/2015 | Kanner | B61L 27/0005 701/20 |

FOREIGN PATENT DOCUMENTS

| | | | |
|---|---|---|---|
| EP | 1547899 | A2 | 6/2005 |
| JP | 2007-331629 | A | 12/2007 |
| JP | 2009-166671 | A | 7/2009 |
| JP | 2010-120484 | A | 6/2010 |
| WO | WO-96/33899 | A1 | 10/1996 |
| WO | WO-2011/096568 | A1 | 8/2011 |

OTHER PUBLICATIONS

Chinese Office Action dated Dec. 23, 2015, which issued in Chinese Application No. 201280047283.4, together with English language translation thereof.

Japanese Office Action dated Dec. 22, 2015, which issued in Japanese Application No. 2011-218253, together with English language translation thereof.

Japanese Patent Office Communication mailed Aug. 11, 2015 in Application No. 2011-218253, with English language translation thereof.

Extended European Search Report dated Nov. 5, 2015, which issued in European Application No. 12837025.1.

Taiwanese Office Action dated Jun. 27, 2016, which issued in Taiwan Application No. 101135731, and English language translation.

Chinese Office Action dated Aug. 16, 2016, which issued in Chinese Application No. 201280047283.4 and English language translation thereof.

* cited by examiner

TRAIN CONTROL SYSTEM

This application is a continuation application of PCT/JP2012/074286, filed on Sep. 21, 2012.

BACKGROUND OF THE INVENTION

1. Field of the Invention

The present invention relates to a train control system, and more specifically, relates to a train control system that can reliably secure a sufficient safety buffer and can enable safer travel control or safer brake control of a train.

2. Description of Related Art

Conventionally, as a train location detection system that detects a train location of a train travelling on a track, a tachometer-generator type train location detection system, in which a tachometer generator is connected to an axle of the train, and a travel distance from a predetermined reference location is calculated based on a pulse output signal generated according to rotational motion of the axle, and then a train location at that time is detected based on the calculated travel distance, is known.

Furthermore, conventionally, in a train control system using a so-called radio distance measurement system, a vehicle radio set is mounted on a train, and a wireless network is formed between the vehicle radio set and a plurality of wayside radio sets, which is spatially separated and disposed along a wayside of the track on which the train travels, and then, a wireless propagation delay (time) between an on-board antenna of the vehicle radio set and a wayside antenna of the wayside radio set is measured, to detect a train location, so that the train control is performed based on the detected train location.

Furthermore, as such a train control system, conventionally, for example, a technique including: a wireless train location detecting unit that detects a train location on a predetermined track based on a propagation time of a radio wave between a vehicle radio set mounted on a train travelling on the predetermined track and a ground radio set disposed at a predetermined location on the ground; a travel distance calculating unit that calculates a travel distance of the train on the predetermined track based on an output signal of a tachometer generator connected to an axle of the train; a temporary reference location setting unit that sets the detected train location detected by the wireless train location detecting unit as a predetermined temporary reference location; and a train location detection calculating unit that detects a train location on the predetermined track based on the temporary reference location set by the temporary reference location setting unit and based on the travel distance calculated by the travel distance calculating unit, has been disclosed (see, Japanese Laid-open Patent Application Publication No. 2007-331629,for example).

According to such a conventional technique, in calculating the travel distance of the train by the tachometer generator, the calculated travel distance may include an error due to slipping or sliding of wheels during the train travelling, and thus, with respect to the train location, safety buffers are set in front of and behind the train, to allow a margin of error of the detected train location, so that even if an error occurs between an actual train location and the calculated train location, the safety can be ensured.

However, since the safety buffer is set according to the detected location of the train and running speed of the train, the safety buffer is set to be short when the running speed of the train is low. Thus, depending on the error between the actual train location and the calculated train location, there might have been a problem in that it may be difficult to secure a sufficient safety buffer.

SUMMARY OF THE INVENTION

The present invention has been made in view of the above problem, and an object of the present invention is to provide a train control system that can reliably secure the sufficient safety buffer and can enable the safer travel control or the safer brake control of the train.

To achieve the above object, an aspect of the present invention provides a train location detection system according to claim 1, including: an on-board device that is mounted on a train travelling on a predetermined track; a vehicle radio set that transmits and receives a travel distance information and speed information of the train obtained by the on-board device; a wayside radio set that is disposed at a predetermined location of the track and transmits information to and receives information from the vehicle radio set; and a ground device that is connected to the wayside radio set, in which the ground device obtains a location of the train based on the travel distance information and the speed information of the train transmitted from the on-board device, and sets a safety buffer on each of a travelling direction side of the train and the other side opposite to the travelling direction side, the safety buffer being only set to be longer, during train travelling.

According to another aspect of the present invention, according to claim 2, in addition to the features of claim 1, the train further includes an absolute location obtaining unit that obtains an absolute location of the train, in which only when the ground device receives the absolute location of the train obtained by the absolute location obtaining unit and transmitted from the on-board device, is the ground device capable of setting the safety buffer to be shorter.

According to a further aspect of the present invention, according to claim 3, in addition to the features of claim 2, the absolute location obtaining unit includes an on-board coil that is mounted on the train and electromagnetically coupled to a ground coil disposed on the track.

According to the embodiment of the invention according to claim 1, the ground device obtains the location of the train based on the travel distance information and the speed information of the train transmitted from the on-board device, and sets the safety buffer on each of the travelling distance side of the train and the other side opposite to the travelling distance side, and furthermore, the safety buffer is only set to be longer, during the train travelling. Thus, even if an error occurs in the calculated location information of the train calculated by the ground device, the sufficient safety buffer can be reliably secured, resulting in the safer travel control or the safer brake control of the train.

According to the embodiment of the invention according to claim 2, the absolute location obtaining unit that obtains the absolute location of the train is provided, and only when the ground device receives the absolute location of the train obtained by the absolute location obtaining unit and transmitted from the on-board device, is the ground device capable of setting the safety buffer to be shorter. Thus, the safety buffer can be set based on the absolute location information of the train.

According to the embodiment of the invention according to claim 3, the absolute location obtaining unit includes the on-board coil that is mounted on the train and electromagnetically coupled to the ground coil disposed on the track. Thus, the safety buffer can be set to be shorter based on the absolute location of the train obtained by the electromagnetic coupling of the ground coil and the on-board coil, and thus, the safety buffer can be set based on the absolute location information of the train.

DESCRIPTION OF THE PREFERRED EMBODIMENTS

Hereinbelow, an embodiment of the present invention will be described with reference to the accompanying drawings.

Figure 1:
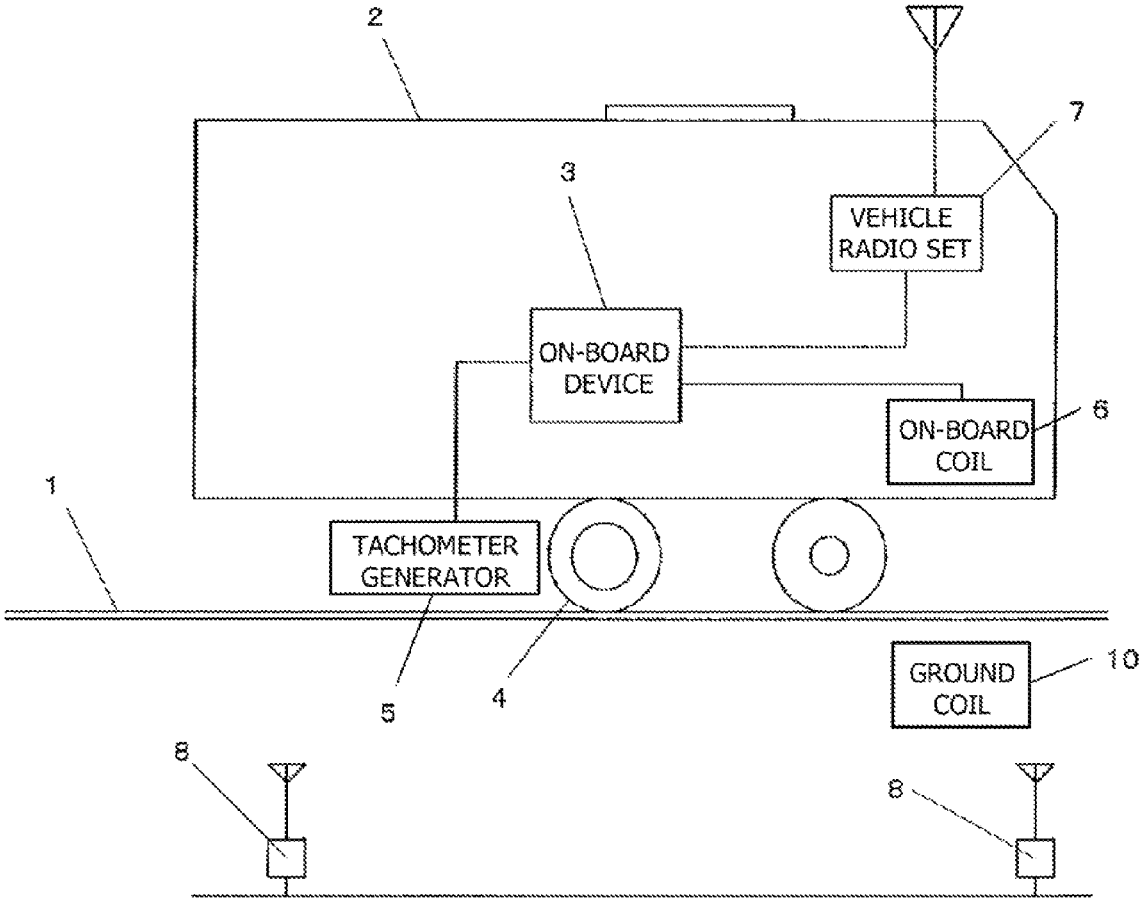
FIG. 1 is a schematic configuration view illustrating a train control system according to an embodiment of the present invention.
Figure 2:
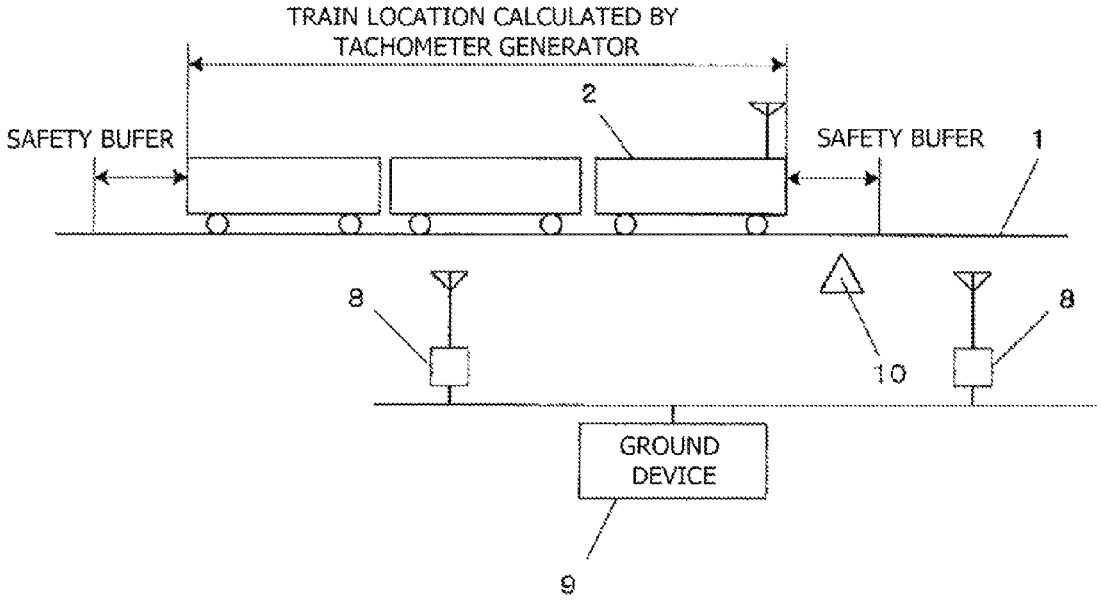
FIG. 2 is an explanatory view illustrating a setting state of a safety buffer in the train control system according to the embodiment of the present invention.

FIG. 1 is a schematic configuration view illustrating a train location detection system according to an embodiment of the present invention. In the present embodiment, on a train 2 that travels on a predetermined track 1, an on-board device 3 is mounted. The on-board device 3 includes a data processing unit, which includes a CPU as a main component, and the on-board device 3 is configured to perform various kinds of control, such as speed control and brake control of the train 2.

To the on-board device 3, a tachometer generator 5 that is connected to an axle of a predetermined wheel 4 of the train 2 and outputs a pulse output signal according to rotational motion of the axle, is connected. Furthermore, at a lower portion of a front of the train 2, an on-board coil 6 is mounted, and the on-board coil 6 is connected to the on-board device 3. The on-board device 3 is configured to calculate the travel distance and the running speed of the train 2 based on a rotation amount of the axle obtained by the tachometer generator 5, and by the on-board device 3, the tachometer generator 5 and the on-board coil 6, the tachometer-generator type train location detection system is constructed.

On the train 2, a vehicle radio set 7 connected to the on-board device 3 is mounted, and the vehicle radio set 7 is configured to be capable of transmitting the travel distance information and the running speed information of the train 2 obtained by the on-board device 3.

Furthermore, a plurality of wayside radio sets 8, that transmits information to and receives information from the vehicle radio set 7, is disposed along the track 1 of the train 2 at a predetermined interval. To the wayside radio sets 8, a ground device 9 is connected. The ground device 9 is configured to obtain a location of the train 2 at that time by calculating the location based on the travel distance information and the running speed information of the train 2 transmitted from the vehicle radio set 7 via the wayside radio sets 8.

In this case, an error may occur between an actual train location and the calculated train location obtained by the ground device 9, due to position resolution of the ground device 9, slipping or sliding of the wheels 4 of the train 2, or the like. Thus, the ground device 9 is configured to set a safety buffer, corresponding to the detection error of the train location, on each of a travelling direction side of the train 2 and the other side opposite to travelling direction side. Then, the ground device 9 is configured to transmit the location information of the train 2 and the set safety buffer information to the on-board device 3 via the wayside radio sets 8 and the vehicle radio set 7, and the on-board device 3 is configured to perform the speed control and the brake control of the train 2 within the safety buffer.

Here, since the safety buffer varies according to a change in speed of the train 2 or the presence or absence of a response from the on-board device 3, the safety buffer constantly varies during travelling. For example, the ground device 9 sequentially obtains information from each wayside radio set 8, and even when the ground device 9 cannot obtain information for several seconds, such as a case in which the ground device 9 cannot obtain the information from a wayside radio set 8, the ground device 9 sets a distance which can ensure the safety for the train 2 as the safety buffer. Furthermore, when the train 2 runs at a lower speed, the safety buffer may be set to a shorter distance, whereas when the train 2 runs at a higher speed, a longer distance is required to be set as the safety buffer.

Furthermore, according to the present embodiment, in setting the safety buffer based on the location information and the running speed information of the train 2, the safety buffer is always set to be longer. That is, when the train speed is high, the safety buffer is set to be longer, and thereafter, even when the train speed transmitted from the vehicle radio set 7 decreases, the safety buffer is not set to be shorter. Thus, even if an error occurs in the location information of the train 2 calculated by the ground device 9, the sufficient safety buffer can be reliably secured.

Furthermore, at a predetermined location of the track 1 of the train 2, a ground coil 10 is disposed, as an absolute location obtaining unit. The on-board device 3 is configured to obtain an absolute location information of the train 2 by the electromagnetic coupling of the on-board coil 6 and the ground coil 10. The absolute location information of the train 2 is transmitted to the ground device 9 via the vehicle radio set 7 and the wayside radio sets 8, and the ground device 9 is configured to set the safety buffer based on the absolute location information of the train 2.

That is, as described above, in setting the safety buffer based on the location information and the running speed information of the train 2, the safety buffer is always set to be longer; however, when the ground device 9 obtains the absolute location information of the train 2, no error occurs between the actual train location and the calculated train location obtained by the ground device 9, and an accurate location of the train 2 can be obtained, and thus, only in this case, the ground device 9 is configured to be capable of setting the safety buffer to be shorter.

Figure 3:
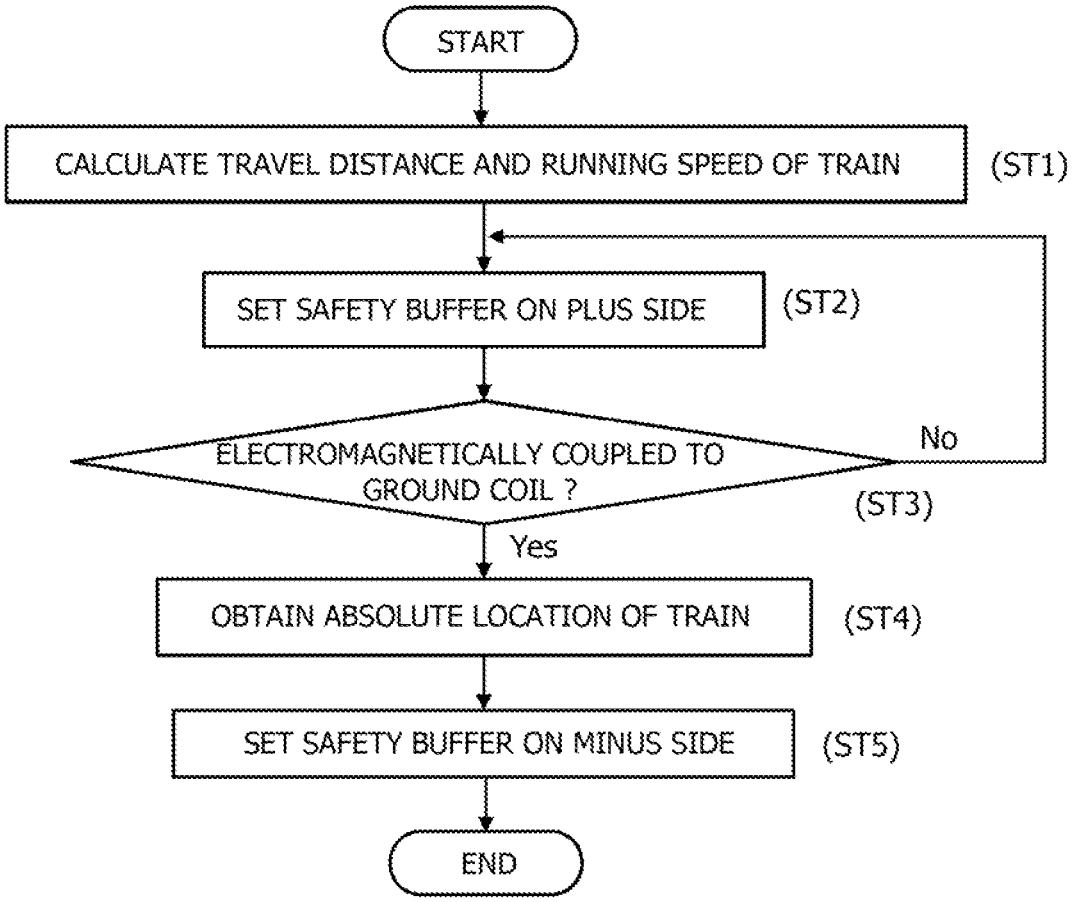
FIG. 3 is a flowchart illustrating an operation of the train control system according to the embodiment of the present invention.

Next, a control operation of the present embodiment will be described with reference to a flowchart of FIG. 3.

First, the on-board device 3 calculates a travel distance and a running speed of the train 2 based on a rotation amount of the axle obtained by the tachometer generator 5 (ST1), and then the on-board device 3 transmits the travel distance information and the running speed information to the ground device 9 via the vehicle radio set 7 and the wayside radio sets 8. Then, the ground device 9 calculates a location of the train 2 at that time based on the travel distance information and the running speed information of the train 2, and sets the safety buffer to the calculated train location on a travelling direction side of the train 2 and on the other side opposite to the travelling direction side.

Then, during the train travelling, the ground device 9 sequentially sets a longer safety buffer based on the travel distance information and the running speed information of the train 2 (ST2). Then, when the ground coil 10 and the on-board coil 6 are electromagnetically coupled to each other during the train 2 travelling (ST3: YES), the on-board device 3 obtains an absolute location information of the train 2. The absolute location information of the train 2 is transmitted from the on-board device 3 to the ground device 9 via the vehicle radio set 7 and the wayside radio sets 8, and when the ground device 9 obtains the absolute location information of the train 2 (ST4), the ground device 9 sets the safety buffer based on the absolute location information. Only in this case, the ground device 9 is capable of setting a shorter safety buffer (ST5).

As described above, according to the present embodiment, in setting the safety buffer based on the location information and the running speed information of the train 2, the safety buffer is always set to be longer, and thus, even if an error occurs in the location information of the train 2 calculated by the ground device 9, the sufficient safety buffer can be reliably secured. As a result, the safer travel control or the safer brake control of the train 2 can be performed. In addition, when the ground device 9 obtains the absolute location information of the train 2, the ground device 9 can set the safety buffer to a shorter safety buffer based on the absolute location information of the train 2.

In the above embodiment, a case in which the on-board coil 6 electromagnetically coupled to the ground coil 10 is used as the absolute location obtaining unit is described. However, the absolute location obtaining unit is not limited thereto, and may include a GPS device, for example.

It should be noted that the entire contents of Japanese Patent Application No. 2011-218253,filed on Sep. 30, 2011, on which convention priority is claimed, is incorporated herein by reference.

It should also be understood that many modifications and variations of the described embodiments of the invention will be apparent to a person having an ordinary skill in the art without departing from the spirit and scope of the present invention as claimed in the appended claims.

What is claimed is:

1. A train control system comprising:

an on-board device that is mounted on a train travelling on a predetermined track;

a vehicle radio set that transmits and receives travel distance information and speed information of the train obtained by the on-board device;

a wayside radio set that is disposed at a predetermined location of the track and transmits information to and receives information from the vehicle radio set; and a ground device that is connected to the wayside radio set, wherein the ground device is configured to:

calculate a location of the train based on the travel distance information and the speed information of the train transmitted from the on-board device, set a safety buffer on each of a travelling direction side of the train and the other side opposite to the travelling direction side, with respect to the calculated location of the train, wherein the safety buffer is set to be lengthened as the train speed increases, whereas the set safety buffer is not shortened when the train speed decreases, during train travelling, and transmit the calculated location of the train and the set safety buffer to the on-board device.

2. The train control system according to claim 1, wherein the train further comprises an absolute location obtaining unit that obtains an absolute location of the train, wherein when the ground device receives the absolute location of the train obtained by the absolute location obtaining unit and transmitted from the on-board device, the set safety buffer is to be shortened.

3. The train control system according to claim 1, wherein the absolute location obtaining unit comprises an on-board coil that is mounted on the train and electromagnetically coupled to a ground coil disposed on the track.

* * * * *